US011473882B2

(12) United States Patent
Michna et al.

(10) Patent No.: US 11,473,882 B2
(45) Date of Patent: Oct. 18, 2022

(54) CANISTER ASSEMBLY WITH PROTECTED CAP WELL AND BOOSTER EXPLOSIVE COMPRISING THE SAME

(71) Applicant: Dyno Nobel Inc., Salt Lake City, UT (US)

(72) Inventors: Richard Joseph Michna, Barkhamsted, CT (US); Tyson James Plitt, Barkhamsted, CT (US); Paul Richard Strebel, Collinsville, CT (US)

(73) Assignee: DYNO NOBEL INC., Salt Lake City, UT (US)

( * ) Notice: Subject to any disclaimer, the term of this patent is extended or adjusted under 35 U.S.C. 154(b) by 0 days.

(21) Appl. No.: 17/176,846

(22) Filed: Feb. 16, 2021

(65) Prior Publication Data

US 2021/0404778 A1 Dec. 30, 2021

Related U.S. Application Data

(60) Provisional application No. 62/978,595, filed on Feb. 19, 2020.

(51) Int. Cl.
*F42B 3/26* (2006.01)
*F42B 3/02* (2006.01)
(Continued)

(52) U.S. Cl.
CPC ..... *F42B 3/08* (2013.01); *C06C 5/04* (2013.01); *F42B 3/24* (2013.01); *F42B 3/26* (2013.01); *F42B 33/0214* (2013.01)

(58) Field of Classification Search
CPC ..... F42B 3/02; F42B 3/08; F42B 3/26
See application file for complete search history.

(56) References Cited

U.S. PATENT DOCUMENTS 2,759,418 A * 8/1956 Ross ..... C06B 43/00 60/39.47
3,092,025 A 6/1963 Hradel et al.
(Continued)

FOREIGN PATENT DOCUMENTS

GB 2257774 A 1/1993
GB 2368626 B 9/2004
(Continued)

OTHER PUBLICATIONS

International Search Report for corresponding international application PCT/US2021/18181, international filing date of Feb. 16, 2021, dated Apr. 27, 2021, 2 pages.
(Continued)

*Primary Examiner* — Derrick R Morgan
(74) *Attorney, Agent, or Firm* — Cantor Colburn LLP

(57) ABSTRACT

A booster explosive (10) comprises a canister body 12 within which is a cap well (20) having disposed therein a detonator (24). A protective sleeve (28) encloses the cap well (20) except for that portion of the cap well, the active portion (20*d*), which encloses the explosive end section (24*a*) of detonator (24). The protective sleeve serves to attenuate the force of shock waves from nearby prior explosions acting on the detonator (24). An annular air space (32) may be provided between protective sleeve (28) and cap well (20) to further attenuate the force of such shock waves. Attenuation of the shock waves reduces the likelihood of damage to detonators (24) by prior nearby explosions.

15 Claims, 4 Drawing Sheets

(51) Int. Cl.

| | |
|---|---|
| ***F42B 3/08*** | (2006.01) |
| ***F42B 3/24*** | (2006.01) |
| ***F42B 33/02*** | (2006.01) |
| ***C06C 5/04*** | (2006.01) |

(56) References Cited

U.S. PATENT DOCUMENTS

| | | | | | |
|---|---|---|---|---|---|
| 3,183,836 | A | | 5/1965 | Griffith | |
| 3,276,372 | A | * | 10/1966 | Cerwonka | F42B 3/26 102/318 |
| 3,355,053 | A | * | 11/1967 | Sexton | F42B 3/02 220/521 |
| 3,407,730 | A | | 10/1968 | Griffith | |
| 3,437,037 | A | | 4/1969 | Newman | |
| 3,437,038 | A | | 4/1969 | Newman | |
| 3,451,341 | A | | 6/1969 | Dittmann | |
| 3,507,218 | A | | 4/1970 | Walker et al. | |
| 3,604,353 | A | | 9/1971 | Newman | |
| 3,831,522 | A | | 8/1974 | Romney | |
| 3,948,177 | A | * | 4/1976 | Fitch | F42B 3/26 102/318 |
| 3,955,504 | A | | 5/1976 | Romney | |
| 4,020,764 | A | | 5/1977 | Beermann | |
| 4,023,494 | A | | 5/1977 | Barton et al. | |
| 4,178,852 | A | | 12/1979 | Smith et al. | |
| 4,295,424 | A | | 10/1981 | Smith et al. | |
| 4,334,476 | A | * | 6/1982 | Day | F42B 3/26 102/466 |
| 4,335,652 | A | * | 6/1982 | Bryan | F42B 3/26 102/202.1 |
| 4,383,484 | A | | 5/1983 | Morrey | |
| 4,425,849 | A | | 1/1984 | Jorgenson | |
| 4,485,741 | A | | 12/1984 | Moore et al. | |
| 4,637,312 | A | * | 1/1987 | Adams | F42B 3/26 102/275.12 |
| 4,765,246 | A | * | 8/1988 | Carlsson | F42D 1/04 102/275.12 |
| 4,776,276 | A | * | 10/1988 | Yunan | C06B 45/00 102/275.12 |
| 4,796,533 | A | * | 1/1989 | Yunan | F42D 1/04 102/275.12 |
| 4,799,428 | A | | 1/1989 | Yunan | |
| 5,522,318 | A | | 6/1996 | Gladden et al. | |
| 5,747,722 | A | | 5/1998 | Gladden et al. | |
| 5,763,816 | A | | 6/1998 | Keeling | |
| 6,112,666 | A | | 9/2000 | Murray et al. | |
| 6,311,621 | B1 | | 11/2001 | Marshall et al. | |
| 6,386,109 | B1 | | 5/2002 | Brooks et al. | |
| 6,397,752 | B1 | | 6/2002 | Yang et al. | |
| 6,520,258 | B1 | | 2/2003 | Yang et al. | |
| 6,554,081 | B1 | | 4/2003 | Brooks et al. | |
| 6,896,059 | B2 | | 5/2005 | Brooks et al. | |
| 7,472,652 | B1 | | 1/2009 | Scheid | |
| 7,778,006 | B2 | | 8/2010 | Stewart et al. | |
| 7,823,508 | B2 | | 11/2010 | Anderson et al. | |
| 7,882,784 | B2 | | 2/2011 | Scheid | |
| 7,882,785 | B2 | | 2/2011 | Scheid | |
| 7,992,495 | B2 | | 8/2011 | Rowe et al. | |
| 8,127,682 | B1 | | 3/2012 | Sonday et al. | |
| 9,115,963 | B2 | * | 8/2015 | Most | B29C 45/14 |
| 11,209,250 | B2 | * | 12/2021 | Zuriaga | F42D 1/043 |
| 2005/0066832 | A1 | | 3/2005 | Mausy | |
| 2011/0036259 | A1 | | 2/2011 | Bengtsson | |
| 2012/0192748 | A1 | | 8/2012 | Scheid et al. | |
| 2014/0345486 | A1 | * | 11/2014 | Most | F42D 1/04 102/314 |

FOREIGN PATENT DOCUMENTS

| | | | |
|---|---|---|---|
| GB | 2398094 | B | 9/2004 |
| RU | 2691033 | C1 | 6/2019 |
| WO | 9725585 | A2 | 7/1997 |
| WO | 0107860 | A2 | 2/2001 |

OTHER PUBLICATIONS

Written Opinion for corresponding international application PCT/US2021/18181, international filing date of Feb. 16, 2021, dated Apr. 27, 2021, 5 pages.

* cited by examiner

CANISTER ASSEMBLY WITH PROTECTED CAP WELL AND BOOSTER EXPLOSIVE COMPRISING THE SAME

BACKGROUND OF THE INVENTION

Field of the Invention

The present invention concerns novel canister assemblies for cast booster explosives, and cast booster explosives comprising the canister assemblies. Cast booster explosives are typically utilized to detonate normally cap-insensitive explosives such as ammonium nitrate and fuel oil ("ANFO") bulk explosives.

Description of Related Art

Cast booster explosives are normally cast with a fuse tunnel and a cap well, the tunnel providing a passageway for a fuse connected to a detonator ("cap"), which is received within the cap well.

The prior art shows canisters for cast booster explosives having fuse tunnels and cap wells as part of a canister body into which a flowable explosive is placed to cure or harden. For example, U.S. Pat. No. 9,115,963, assigned to the assignee of the present application, discloses a plastic canister having a fuse tunnel (22) formed integrally with the canister body (12) and a separate cap well (14) which may be secured within the canister body by means of a cap well mounting fixture (28). U.S. Pat. No. 6,311,621 discloses an electronic circuit assembly in an encapsulation which may be enclosed within, e.g., a metal sleeve. In addition, see U.S. Pat. No. 4,334,476 issued Jun. 15, 1982 to John T. Day et al. for "Primer Cup", U.S. Pat. No. 3,183,836 issued May 18, 1965 to G. L. Griffith for "Canister For Cast Primer", U.S. Pat. No. 3,955,504 issued May 11, 1976 to Russell H. Romney for "Explosive Booster Casing", U.S. Pat. No. 3,407,730 issued on Oct. 29, 1968 to G. L. Griffith for "Retainer For Holding A Detonator In A Detonator Receptacle And Explosive Cartridge Container Containing The Same", and U.S. Pat. No. 6,112,666 issued on Sep. 5, 2000 to C. M. Murray et al. for "Explosives Booster and Primer".

U.S. Pat. No. 4,425,849 issued on Jan. 17, 1984 to Gordon K. Jorgenson for "Primer Assembly" discloses an explosive primer assembly which utilizes (FIG. 2) a primer explosive composition 6 which is initiated by a detonator 12 disposed within a cap well 8. Initiation is effectuated by a wire conductor 14 which passes through a toroid 10 which effectuates the initiation by electromagnetic induction. The embodiment illustrated in FIG. 4 (column 3, line 61 et seq.) encases detonator 12 within a tube 35 in order to provide a stable attachment of body 29 and its cover 30 to the cartridge of primer explosive shown in FIG. 4. Tube 35 has barbs 36 to help retain body 29 in place when tube element 35 is pressed into the cartridge.

GB Patent Application 2 257 774 A to Hartley Hodgson published on Jan. 20, 1993 discloses a shaped explosive charge 13 (FIG. 2) having a metal barrier plate 1 having (FIG. 2) a cup-like deflector 4 and peripheral annular slots 6. Barrier plate 1 serves to deflect to the periphery of explosive charge 13 the explosive force of disc-like initiating charge 10 (FIG. 2). Charge 10 is initiated by detonator 17/explosive pellet 18.

GB Patent 2 368 626 B to Wenbo Yang et al. published on Sep. 8, 2004 is one of several Schlumberger patent publications showing provision of a shock-absorbing barrier to shield the explosives of well-perforating guns from the shock waves generated by adjacent explosives. Two basic shielding techniques are disclosed. One, as illustrated in FIG. 3, is to enclose the perforating gun explosive charges 506 with a shock-impeding powder material 510 emplaced within sleeve 512. The shock-impeding material may be a porous cement comprising a mixture of cement and hollow microspheres (see the paragraph bridging pages 9 and 10 of this patent). Another shock-impeding technique is illustrated in FIG. 7 of the patent where barriers 410 are interposed between shaped charges 412. This GB patent and some other Schlumberger references, including UK Patent GB 2 398 094 B and U.S. Pat. No. 6,896,059, show the broad concept of shielding explosives from shock waves generated by adjacent explosives. The pertinent portions of these three patents are substantially similar to GB 2 368 626 B and thus are merely cumulative to each other.

In use, as is well known in the art, cast booster explosives are normally lowered into a borehole, which may be as deep as 10, 20 or 30 feet (3, 6.1 and 9.1 meters, respectively) or deeper. More than one booster may be loaded into a given borehole and in such case the two or more boosters are normally positioned at different depths within a given borehole. The booster explosive(s) are employed to initiate a bulk explosive such as an ANFO slurry or emulsion which is poured into the borehole.

As is also well-known, booster explosives are utilized in blasting systems which may comprise numerous boreholes filled with a suitable cap-insensitive explosive such as an ANFO slurry or emulsion. It is important that the sequence of explosions from borehole to borehole be carefully timed so that each borehole is detonated at an appropriate time in order to maximize blasting efficiency. If a "downstream" borehole is intended to be detonated after an adjacent or nearby "upstream" borehole, it is possible that the shock wave from the detonation of the upstream borehole may damage the detonator in the downstream borehole, so as to prevent the downstream borehole from initiating. The circuitry of electronic delay detonators is particularly vulnerable to damage by the shock waves generated by prior upstream or adjacent explosions. Failure of any borehole to detonate is of course highly undesirable. Detonation failures result in uninitiated explosives in muck piles, present severe safety hazards and greatly reduce the efficiency of the blasting system.

SUMMARY OF THE INVENTION

Generally, the present invention provides a canister assembly and a booster explosive comprising the canister assembly. The canister assembly has a cap well which is protected by a shock-absorbing barrier to reduce the possibility of damage to the detonator lodged within the cap well by shock waves generated by prior adjacent explosions. The shock wave protection for the detonator is attained by enclosing a substantial portion of the cap well within a shock-absorbing barrier which may comprise a protective sleeve, while leaving unshielded an active section of the cap well, that is, the section of the cap well which encloses the explosive end section of the detonator. Leaving the explosive end section unshielded facilitates planned initiation by the detonator of the cast booster explosive surrounding the cap well. The protective sleeve may be made of any suitable material such as metal or plastic or a closed cell synthetic polymeric foam, or a combination thereof.

Specifically, in accordance with the present invention there is provided a canister assembly for a cast booster explosive, the canister assembly comprising: a canister body defining a canister interior, and having a canister base, a cap well of generally tubular configuration disposed within the canister interior, the cap well having a length, an outside diameter, an active section terminating in a distal closed end, and a proximal open end, the cap well being configured to receive therewithin a detonator comprising a shell having an explosive end section and a firing train section, such detonator to be disposed within the cap well with at least a portion of such explosive end section disposed in the active section of the cap well. A protective sleeve surmounts the cap well and encloses a major portion of the length of the cap well, the protective sleeve being configured to leave exposed the active section of the cap well.

One aspect of the present invention provides that the active section of the cap well is dimensioned to contain the entire explosive end section of such detonator.

Another aspect of the present invention provides that the protective sleeve has an inside diameter which is greater than the outside diameter of the cap well, which results in an annular cap well space between the inside diameter of the protective sleeve and the outside diameter of the cap well.

Other aspects of the present invention provide one or more of the following features, alone or in any suitable combination: the protective sleeve has a terminal end which terminates adjacent the active section of the cap well, and the canister assembly further comprises a sleeve seal closing the annular cap well space at the terminal end of the protective sleeve; the protective sleeve has a base end opposite the terminal end and the base end of the protective sleeve is mounted on the canister base in order to seal the annular cap well space at the base end of the protective sleeve; and the annular cap well space has a thickness of from about 0.05 inch (0.127 cm) to about 0.08 inch (0.203 cm).

Still other aspects of the present invention provide that the protective sleeve comprises a tube, e.g., a metal tube, the tube having one or more of the following characteristics: a wall thickness of from about 0.05 inch (0.127 centimeter) to about 0.07 inch (0.178 centimeter); a length of from about 2 inches (5.08 centimeters) to about 3 inches (7.62 centimeters); and an outer diameter of from about 0.7 inch (1.78 centimeters) to about 1 inch (2.54 centimeters).

Other aspects of the present invention provide for a canister assembly further comprising one or both of a cast booster explosive disposed within the canister interior and a fused detonator disposed within the cap well.

DETAILED DESCRIPTION OF THE INVENTION AND SPECIFIC EMBODIMENTS THEREOF

Figure 1:
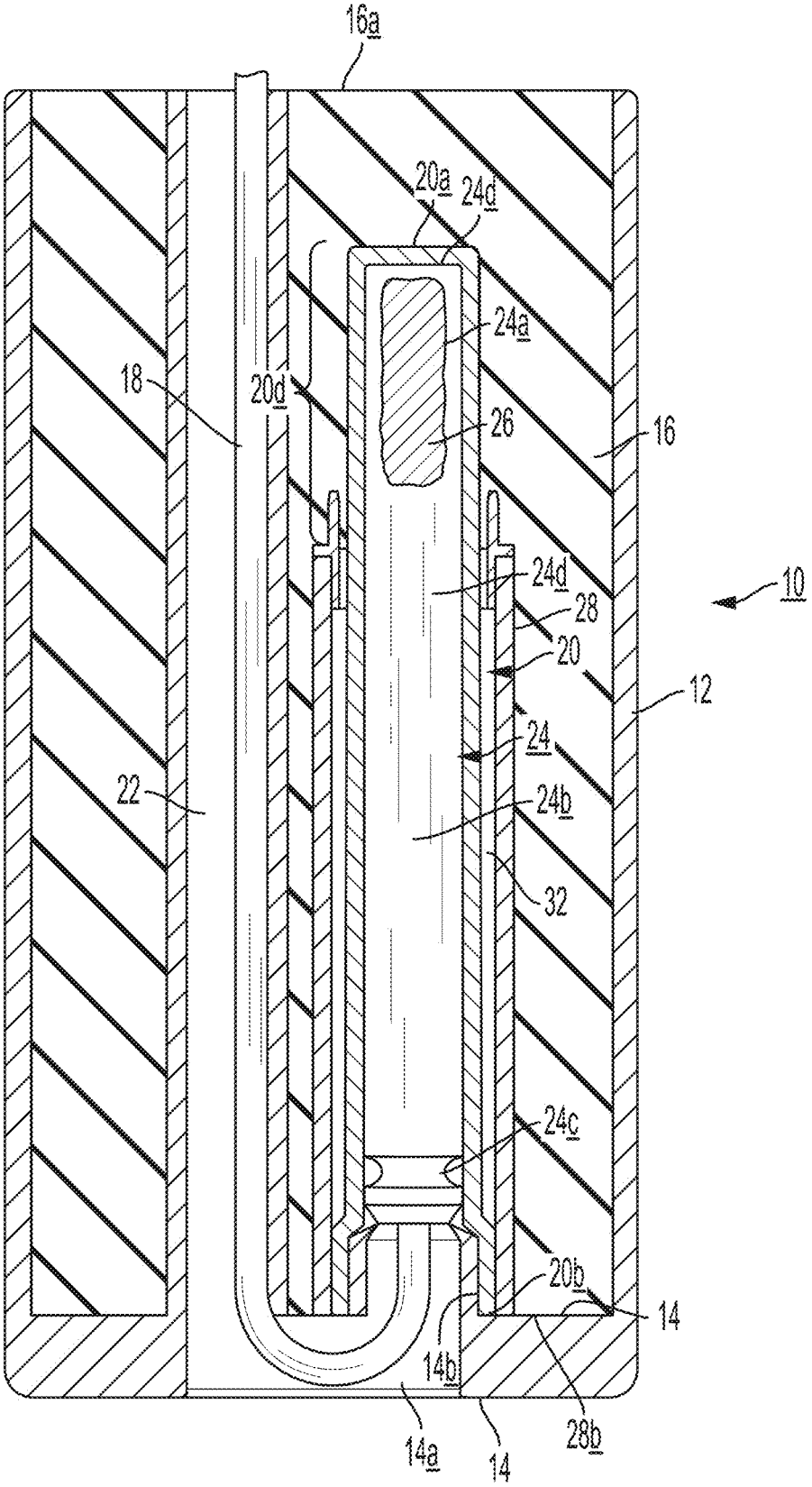
FIG. 1 is a schematic cross-sectional view in elevation of one embodiment of the present invention showing, with parts broken away, a booster explosive comprising a detonator enclosed within a cap well which itself is enclosed for a substantial portion of its length within a shock-absorbing barrier provided by a protective sleeve.
Figure 1A:
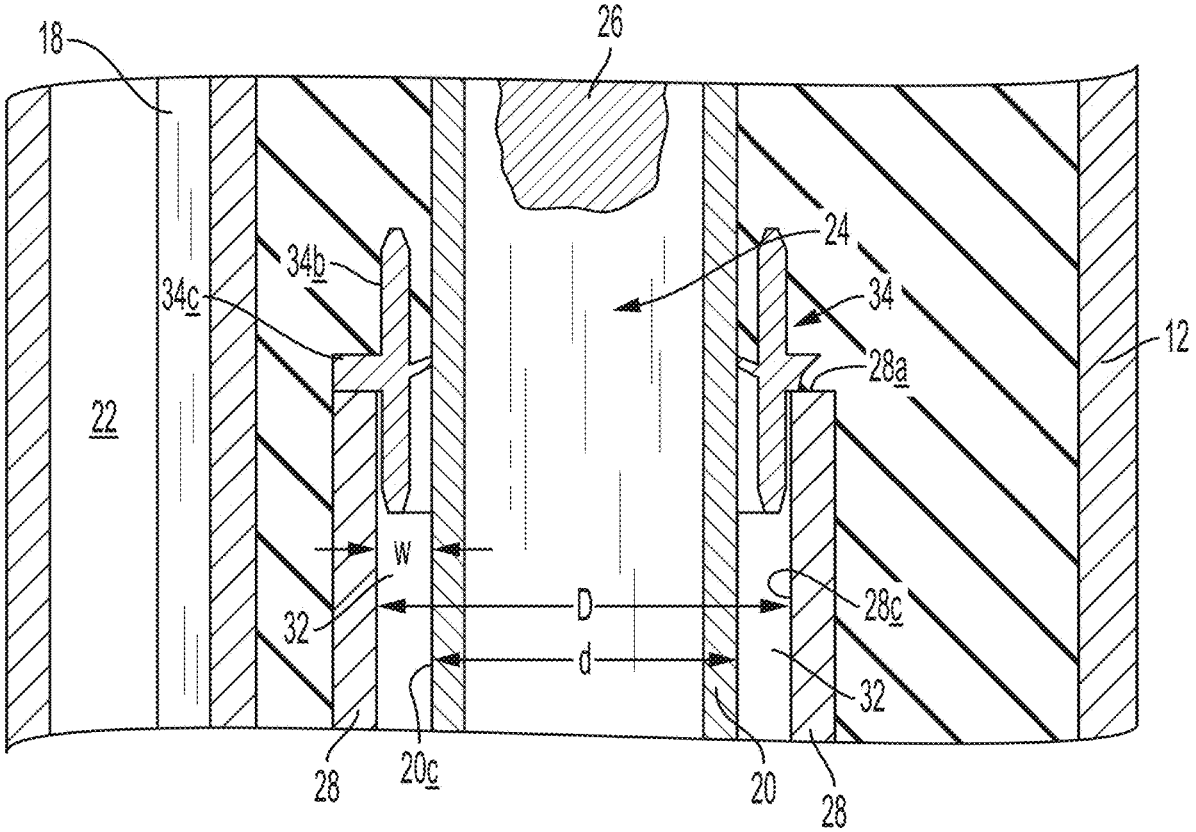
FIG. 1A is a partial view, enlarged relative to FIG. 1, showing the upper portion of the sleeve seal of FIG. 1.

Referring now to FIGS. 1 and 1A, there is shown an embodiment of the present invention wherein a canister assembly (un-numbered) comprises part of a booster explosive 10. The canister assembly comprises a canister body 12 having a canister base 14 in which an open base passage 14*a* and a cap well mounting fixture 14*b* are formed. A cap well 20 is mounted on cap well mounting fixture 14*b* and is surmounted by a protective sleeve 28 along a portion of its length.

Figure 1B:
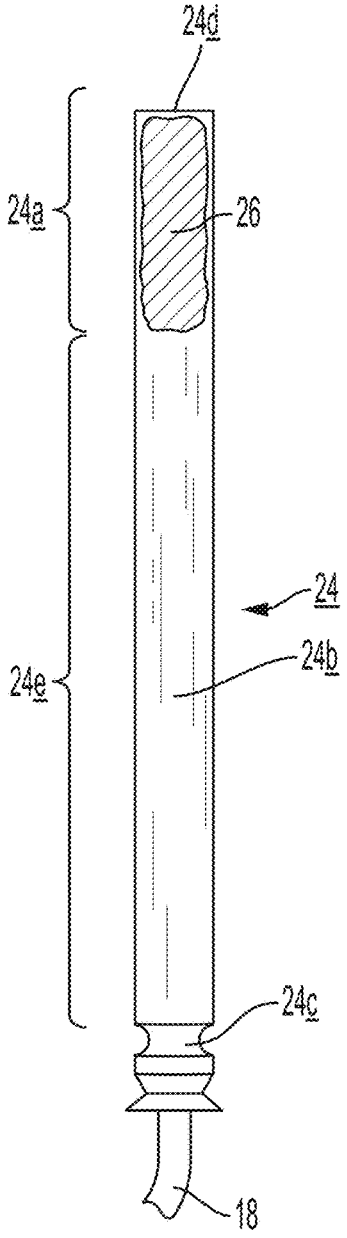
FIG. 1B is a view of the detonator shown in FIG. 1.

Contained within the body 12 of the canister assembly is a cast explosive 16, which, as is well known in the art, may be Pentolite or the like. Cast explosive 16 has formed therein a cavity (un-numbered) which is configured to receive cap well 20 and the protective sleeve 28, as more fully described below. Cast explosive 16 has also formed therein a fuse tunnel 22. A detonator 24 has connected to it a fuse 18, which may be shock tube or any other suitable fuse extending from the fuse end (unnumbered) of detonator 24 through base passage 14*a*, thence through fuse tunnel 22 and outwardly of fuse tunnel 22 at the top 16*a* of cast explosive 16, in the usual manner. Cap well 20 has a distal closed end 20*a* and a proximal open end 20*b*, the latter of which is securely mounted onto cap well mounting fixture 14*b*. The cap well itself may comprise a synthetic polymeric material (plastic) closed at one end and open at its opposite end to receive the detonator therein, as shown in the canister described in the above-mentioned U.S. Pat. No. 9,115,963. However, any suitable canister and cap well configuration is useable in the present invention. The canister body 12 and canister base 14 and, if present, an optional canister top (not shown) may be made of molded plastic or any suitable material such as waxed or coated cardboard, plastic sheeting, or the like. Detonator 24 is disposed within cap well 20 with the explosive end section 24*a* of detonator 24 (FIG. 1B) at or adjacent to the closed end 20*a* of cap well 20. As seen in FIG. 1B, detonator 24 is of conventional construction and is comprised of a shell 24*b* having the usual crimp 24*c* closing the open end of shell 24*b*, and a detonator tip 24*d*. Detonator 24 further has a firing train section 24*e* which contains, as is well known in the art, an electronic or pyrotechnic firing train. Firing train section 24*e* is the portion of the detonator 24 protected by protective sleeve 28.

Detonator 24, which may be of conventional construction, is positioned within cap well 20 with detonator explosive charge 26 positioned at or immediately adjacent to the distal closed end 20*a* of cap well 20. A small air head space (not shown) may optionally be left between the tip 24*d* of detonator 20 and the distal closed end 20*a* of cap well 20.

Those skilled in the art will understand that the canister assembly and cast booster explosive of the present invention may be made by any suitable manufacturing process. An efficient process is to mold from a suitable synthetic polymeric material canister body 12 integrally with fuse tunnel 22 and to separately mold cap well 20 from the same or a different synthetic polymeric material, as disclosed in the above-mentioned U.S. Pat. No. 9,115,963. Cap well 20, protective sleeve 28 and sleeve seal 34 are then mounted within canister body 12. Thereafter, a flowable explosive is introduced into canister body 12 and hardens into cast explosive 16. Normally, the detonator 24 and its fuse 18 are not inserted until the point of use, for obvious safety reasons.

In FIGS. 1 and 1A, the shell 24*b* of detonator 24 is broken away at the explosive end section 24*a* thereof in order to show detonator explosive charge 26. A shock-absorbing barrier is comprised, in the illustrated embodiment, of a protective sleeve 28, which extends from the proximal open end 20*b* of cap well 20 and stops short of the portion of cap well 20 which encloses explosive end section 24*a* of detonator 24. Thus, the terminal end 28*a* (FIG. 1A) of protective sleeve 28 stops short of detonator explosive charge 26 contained within explosive end section 24*a*. As seen in FIG. 1, protective sleeve 28 extends to the proximal open end 20*b* of cap well 20.

An annular air space is provided between the outside diameter of the cap well and the inside diameter of the protective sleeve. Although the protective sleeve snugly fitted about the exterior of the cap well may serve as the sole shock absorbing barrier, improved shock resistance is attained by a combination of a protective sleeve and an annular air space between the exterior of the cap well and the interior of the protective sleeve. As seen in FIG. 1A, the inside diameter D of protective sleeve 28 is greater than the outside diameter d of cap well 20 so that the width w of the annular air space is (D−d)/2. As is conventional practice, cap well 20 is tapered along its length to be of slightly smaller diameter at distal closed end 20*a* (FIG. 1) than at proximal open end 20*b*. The tapered inside diameter facilitates insertion of detonator 24 into cap well 20 from open end 20*b* of cap well 20. The identically tapered outside diameter d (FIG. 1A) of cap well 20 results in the width w of the annular air space 32 gradually increasing in size from adjacent open end 20*b* to adjacent closed end 20*a*. The size range of width w may of course differ from one to another embodiment of the invention. In some embodiments, width w ranges from about 0.05 inch (0.127 cm) to about 0.08 inch (0.203 cm), or from about 0.05 inch (0.127 cm) to about 0.075 inch (0.191 cm), or from about 0.052 inch (0.132 cm) to about 0.072 inch (0.183 cm). Water, soil and other foreign materials, as well as the bulk explosive slurry or emulsion, or cast explosive pentolite or the like, must be kept out of the annular air space if the air space is to provide effective shock wave attenuation. The annular air space is therefore sealed at both ends of the protective sleeve as described below. These expedients serve to reduce the transmission of shock waves from prior adjacent explosions to a detonator within the cap well, thereby reducing the chance of damage to an adjacent, e.g., "downstream" detonator, and subsequent borehole failure. "Downstream" and "upstream" are relative terms used in the sense that the sequence of explosions travels from upstream to downstream. Thus, an upstream booster explosive is intended to be detonated before a downstream booster explosive.

The annular air space surrounding the cap well containing the detonator enhances the shock wave protection as compared to the protective sleeve snugly fitted around the cap well. Either arrangement, a snugly-fitted protective sleeve or a protective sleeve which provides an annular air space, is a much poorer transmission medium for explosive shock waves than would be a solid cast explosive such as Pentolite disposed in direct contact with the cap well.

Figure 2:
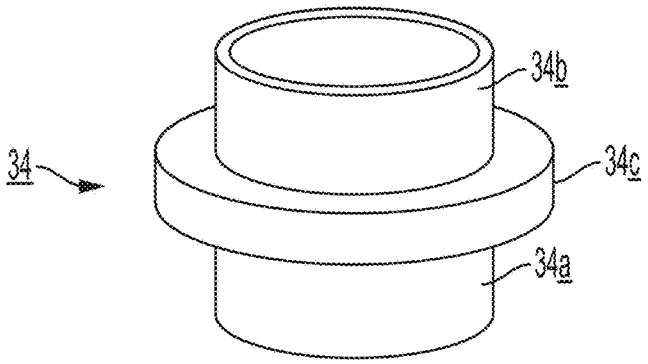
FIG. 2 is a perspective view of the sleeve seal best seen in FIG. 1A.

The annular air space 32 should be protected against infiltration by ground water, soil particles, particles of ammonium nitrate from the ANFO, etc., especially if the cast booster explosive is positioned within a borehole for a significant length of time before detonation. Such infiltration will greatly reduce or eliminate the shock-absorbing ability of the annular air space. In order to prevent such infiltration into the annular air space 32, which is formed between the outer wall 20*c* (FIG. 1A) of cap well 20 and the inner wall 28*c* of protective sleeve 28, the terminal end 28*a* of protective sleeve 28 is closed by a sleeve seal 34. Sleeve seal 34 is of generally annular configuration and may be formed of any material suitable for sealing against liquid or particulate infiltration, for example, sleeve seal 34 may be made of a suitable rubber or other natural or synthetic polymeric material. As seen in FIGS. 1A and 2, sleeve seal 34 comprises a tubular body 34*a* from which an annular crown 34*b* extends longitudinally, and a ring 34*c* extends radially of tubular body 34*a* and rests on the terminal end 28*a* of protective sleeve 28. A portion of ring 34*c* at the right-hand side of FIG. 1A is broken away to better show a portion of terminal end 28*a* of protective sleeve 28. Sleeve seal 34 is sufficiently compressible to form a tight force-fit seal to close the terminal end 28*a* of protective sleeve 28 to prevent infiltration of ground water, etc., into annular air space 32. Generally, sleeve seal 34 may comprise any suitable elastomeric material such as a water-resistant rubber such as that sold under the trademark NEOPRENE®. As seen in FIG. 1, the bottom of protective sleeve 28 is sealed by being firmly seated on canister base 14.

In another embodiment of the present invention, the protective sleeve 28 may be a close fit about the outside wall of cap well 20 so as to substantially eliminate the annular air space 32. This embodiment is obtained by a force-fit of protective sleeve 28 about most of the exterior wall of cap well 20 stopping short of at least the portion of cap well 20 which encloses the explosive end section 24*a* of detonator 24. In this embodiment the protective sleeve alone is relied upon to provide attenuation of shock waves from prior adjacent explosions.

As noted above, protective sleeve 28 may be made of any suitable material, for example, any suitable metal such as brass or any suitable synthetic polymer (plastic) material, or wood, cardboard, etc., or combinations thereof. Protective sleeve 28, when made of brass, may be a seamless tube having a wall thickness of at least about 0.05 inch (0.127 centimeter), for example, from about 0.05 inch to about 0.06 inch (0.152 centimeter) or from about 0.05 inch to about 0.070 inch (0.178 centimeter). The length of protective sleeve 28 and the other exemplary dimensions given herein may of course vary depending on the specific dimensions of the cap well, the degree of desired shock wave protection, etc. For example, the length of protective sleeve 28 may vary from about 2 inches (5.08 centimeters) to about 3 inches (7.62 centimeters) in length, and the outer diameter of protective sleeve 28 may be from about 0.7 inch (1.78 centimeters) to about 1 inch (2.54 centimeters). While a tube as described above is simple to manufacture, obviously the protective sleeve, whether dimensioned to be a snug, close fit around the cap well or dimensioned to provide an annular air gap, may be of more complex design, e.g., it may comprise a multi-layer tube with layers of different materials, a coated tube, etc.

In other embodiments of the present invention, which may be referred to as "central cap well" embodiments, the cap well may be positioned to extend along the central longitudinal axis of the canister so that the cap well and the detonator contained therein are equidistant from the canister wall in all directions. This results in the same degree of protection from shock waves by the surrounding body of cast explosive regardless of the orientation of the booster explosive to the source of the shock wave, i.e., to the location of a nearby explosive which is to be detonated before the booster charge of the invention.

Figure 3:
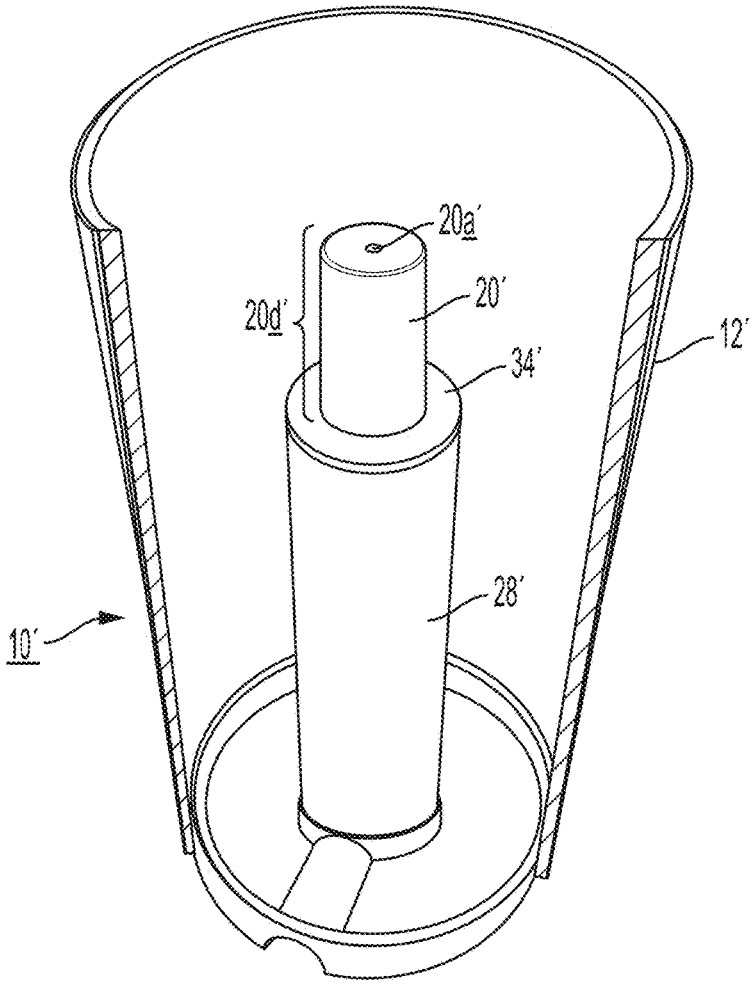
FIG. 3 is a view with parts broken away or omitted for clarity of illustration, showing the interior of a central cap well embodiment of the present invention.

FIG. 3 shows a central cap well booster explosive 10' with a cardboard canister body 12' broken away and cast booster explosive and detonator omitted for clarity of illustration.

Cap well 20' is seen to be disposed along the central longitudinal axis of booster explosive 10' and the fuse tunnel (not shown in FIG. 3) will of necessity be offset from the central longitudinal axis. A protective sleeve 28' extends from the bottom of the cap well 20' and stops short of the closed end 20*a*' of cap well 20' in order to leave unshielded by sleeve 28' the active section 20*d*' of cap well 20, that is, the portion of cap well 20' which houses the explosive end section of the detonator (not shown in FIG. 3). This facilitates initiation of the cast booster (not shown in FIG. 3) surrounding and enclosing cap well 20' and protective sleeve 28'. Sleeve seal 34' seals the top of the protective sleeve 28' to prevent entry of foreign objects into the annular air space formed between the exterior of cap well 20' and protective sleeve 28'.

A series of tests was conducted by suspending prototype test embodiments of booster explosives of the present invention in water spaced apart at different selected distances from a donor explosive charge. The donor explosive charges were suspended in the water at the same depth as the test embodiments, at about 6 feet (1.83 meters) below the surface. The donor charges comprised two 900 gram Pentolite charges, to provide a donor charge of 1,800 grams of Pentolite. Each of the test embodiments was configured so that the distance between the cap well (20, FIG. 1) and the wall of the canister body (12, FIG. 1) varied from 0.5 inch (1.27 centimeters) to 1.2 inches (3.05 centimeters). The test embodiments were not oriented rotationally to the donor charges during the tests. Consequently, the amount of cast explosive between the cap well and the wall of the canister body which directly faced the oncoming shock wave randomly varied between 0.5 and 1.2 inches (1.27 to 3.05 centimeters). Both the donor charges and the test embodiments utilized electronic delay detonators. The tests were conducted by initiating both the donor and test embodiment detonators at the same time, with the donor charge delay detonator programmed to detonate while the test embodiment delay detonator was still counting down towards its detonation time. Those of the test embodiment detonators which were significantly damaged by the shock wave generated by the donor charge failed to initiate their associated explosive charges. The test results are graphically shown in FIG. 4, which shows on the left-hand vertical axis the percentage of test embodiments which were not damaged by the shock wave engendered by detonation of the donor charges. (A single donor charge was used for a single test embodiment in each test.) The graph thus shows the percentage of test embodiment booster explosives which functioned properly, that is, which were not damaged by the donor explosive shock wave. The horizontal axis of the chart shows the distance in feet between the test embodiments and the donor charges. The indicated distances are center to center distances between the donor charge and the test embodiment.

Figure 4:
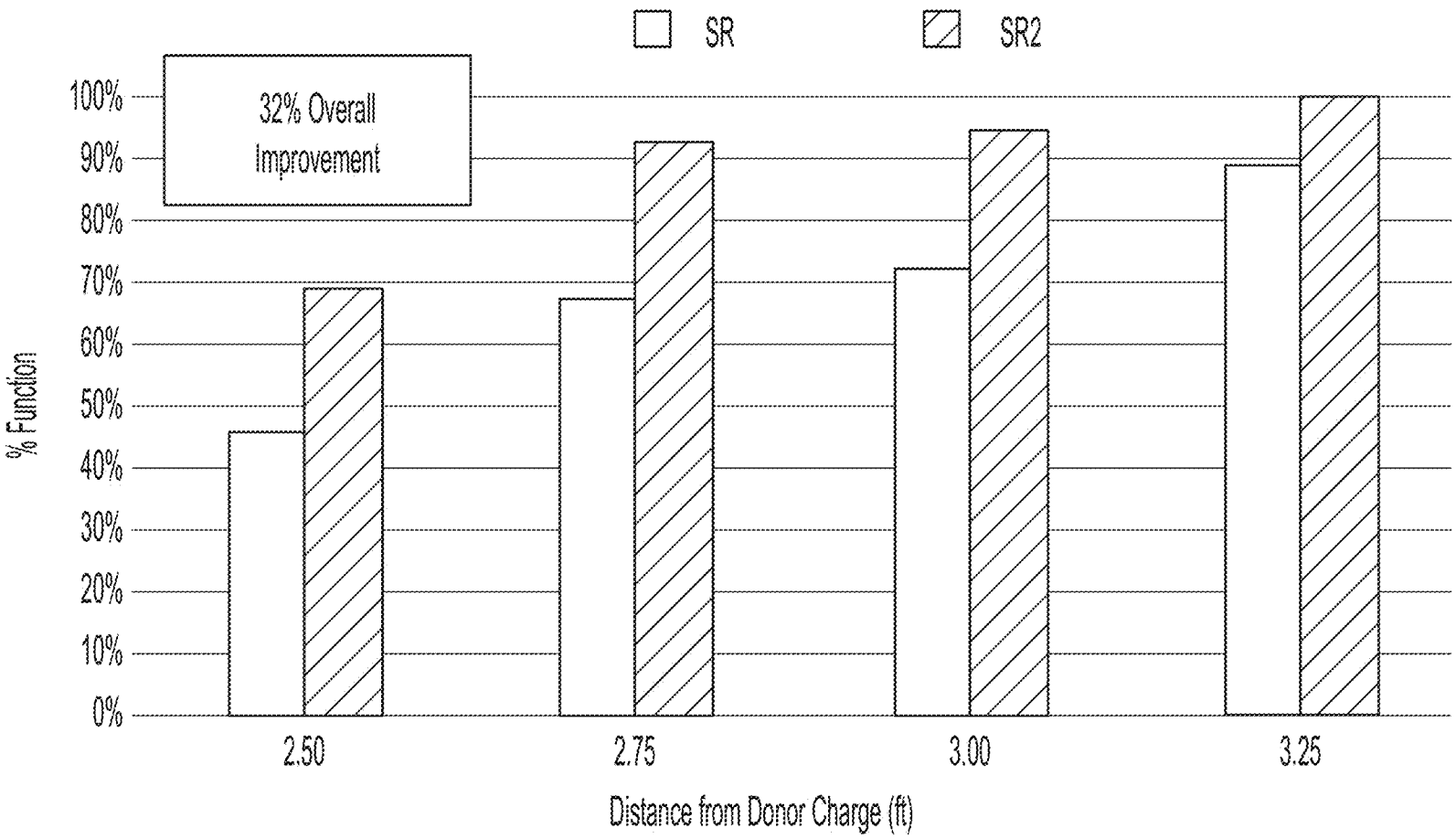
FIG. 4 is a graph showing the shock wave resistance demonstrated by two different embodiments of the present invention.

The test embodiments identified as "SR" in the graph of FIG. 4 are embodiments as described herein where there is no annular air space, i.e., the protective sleeve 28 fits snugly about the exterior of the cap well 20. The test embodiments identified in the graph of FIG. 4 as "SR2" are in accordance with the illustrated embodiments of the present invention wherein the annular air space 32 (FIG. 1A) is about 0.05 inch (0.13 centimeter) wide. That is, there is about 0.05 inch (0.13 centimeter) distance between the exterior wall of cap well 20 and the interior wall of protective sleeve 28. The protective sleeve 28 used in all test embodiments was a brass sleeve 0.73 inch (1.85 centimeters) in outer diameter with a wall thickness of 0.065 inch (0.165 centimeter). The brass sleeve was 2.7 inches (6.9 centimeters) in length, leaving the portion of the cap well which enclosed the explosive end section 24*a* of detonator 24 exposed, i.e., uncovered by protective sleeve 28.

Each test embodiment utilized an electronic delay detonator sold under the trademark DigiShot® by Dyno Nobel Inc., and programmed for a 1,500 millisecond delay. The delay detonator was 3.5 inches (8.9 centimeters) in length and had an explosive end about 1 inch (2.54 centimeters) in length which contained about 0.1 gram of lead azide initiator enclosed by a base charge comprised of about 0.8 gram of PETN.

Each test embodiment comprised a booster explosive containing 450 grams of Pentolite in a plastic cylinder measuring about 5 inches (12.7 centimeters) in length and about 2 inches (5.1 centimeters) in diameter.

The results plotted in the graph of FIG. 4 may be tabulated as follows.

TABLE

| Distance In Feet From | Percentage of Test Embodiments That Were Not Damaged By Donor Explosive Shock Wave | |
|---|---|---|
| Donor Charge (meters) | SR | SR2 |
| 2.50 (0.762) | 47% | 69% |
| 2.75 (0.808) | 68% | 93% |
| 3.00 (0.914) | 72% | 95% |
| 3.25 (0.991) | 89% | 100% |

It is seen that while the SR embodiment, having a brass protective sleeve snugly fitted about the cap well, provides protection against shock wave damage, the degree of protection is significantly enhanced by the provision of an annular air space in the SR2 embodiment, using a protective sleeve which was identical to that used in the SR embodiments.

While the invention has been described in detail with reference to specific embodiments, it will be appreciated that numerous variations may be made to the described embodiments, which variations nonetheless lie within the scope of the present invention.

What is claimed is:

1. A canister assembly for a cast booster explosive, the canister assembly comprising:

a canister body defining a canister interior, and having a canister base, a cap well of generally tubular configuration disposed within the canister interior, the cap well having a length, an outside diameter, an active section terminating in a distal closed end, and a proximal open end, the cap well being configured to receive therewithin a detonator comprising a shell, an explosive end section and a firing train section, such detonator to be disposed within the cap well with at least a portion of such explosive end section disposed in the active section of the cap well; and a protective sleeve surrounding and enclosing a major portion of the length of the cap well, the protective sleeve being configured to leave exposed the active section of the cap well.

2. The canister assembly of claim 1 wherein the active section of the cap well is dimensioned to contain the entire explosive end section of such detonator.

3. The canister assembly of claim 1 or claim 2 wherein the protective sleeve has an inside diameter which is greater than the outside diameter of the cap well whereby to define an annular cap well space between the inside diameter of the protective sleeve and the outside diameter of the cap well.

4. The canister assembly of claim 3 wherein the protective sleeve has a terminal end which terminates adjacent the active section of the cap well, the canister assembly further comprising a sleeve seal closing the annular cap well space at the terminal end of the protective sleeve.

5. The canister assembly of claim 3 wherein the protective sleeve has a base end opposite the terminal end and wherein the base end of the protective sleeve is mounted on the canister base whereby to seal the annular cap well space at the base end of the protective sleeve.

6. The cannister assembly of claim 3 wherein the annular cap well space has a thickness of from about 0.05 inch (0.127 cm) to about 0.08 inch (0.203 cm).

7. The canister assembly of claim 3 wherein the protective sleeve comprises a tube having a wall thickness of from about 0.05 inch (0.127 centimeter) to about 0.07 inch (0.178 centimeter).

8. The canister assembly of claim 3 wherein the protective sleeve has a length of from about 2 inches (5.08 centimeters) to about 3 inches (7.62 centimeters).

9. The canister assembly of claim 3 wherein the protective sleeve has an outer diameter of from about 0.7 inch (1.78 centimeters) to about 1 inch (2.54 centimeters).

10. The canister assembly of claim 3 wherein the protective sleeve comprises a metal tube.

11. A canister assembly for a cast booster explosive, the canister assembly comprising:

a canister body defining a canister interior, and having a canister base, a cap well of generally tubular configuration disposed within the canister interior, the cap well having a length, an outside diameter, an active section terminating in a distal closed end, and a proximal open end, the cap well being configured to receive therewithin a detonator comprising a shell, an explosive end section and a firing train section, such detonator to be disposed within the cap well with at least a portion of such explosive end section disposed in the active section of the cap well;

a protective sleeve surrounding and enclosing a major portion of the length of the cap well, but leaving the active section of the cap well exposed, the protective sleeve having a base end and an opposite terminal end, the terminal end terminating adjacent the active section of the cap well;

the canister assembly further comprising a sleeve seal mounted on the terminal end of the protective sleeve to seal the annular cap well space at the terminal end of the protective sleeve, and the base end of the protective sleeve is mounted on the canister base to seal the annular cap well space at the base end of the protective sleeve; and the protective sleeve further having an inside diameter which is greater than the outside diameter of the cap well whereby to define an annular cap well space between the inside diameter of the protective sleeve and the outside diameter of the cap well.

12. The canister assembly of claim 1, claim 2 or claim 11 further comprising a cast booster explosive disposed within the canister interior.

13. The canister assembly of claim 12 further comprising a detonator disposed within the cap well.

14. The canister assembly of claim 3 further comprising a cast booster explosive disposed within the canister interior.

15. The canister assembly of claim 14 further comprising a detonator disposed within the cap well.

* * * * *